US005413522A

United States Patent [19]

Husson

[11] Patent Number: 5,413,522

[45] Date of Patent: May 9, 1995

[54] DEBURRING METHOD AND MACHINE

[75] Inventor: Raymond Husson, Nancy, France

[73] Assignee: Pont-A-Mousson S.A., Nancy, France

[21] Appl. No.: 193,892

[22] Filed: Feb. 9, 1994

Related U.S. Application Data

[60] Continuation of Ser. No. 976,251, Nov. 13, 1992, abandoned, which is a division of Ser. No. 932,935, Aug. 21, 1992, Pat. No. 5,321,914.

[30] Foreign Application Priority Data

Aug. 22, 1991 [FR] France ..... 91 10536

[51] Int. Cl.[6] ..... B24B 49/12

[52] U.S. Cl. ..... 451/21; 451/6; 451/5

[58] Field of Search ..... 51/165.71, 165.72, 165.75, 51/165.87, 281 R, 289 R, 215 AR, 215 UE, 237 T; 451/5, 6, 9, 21, 332, 339, 401, 28, 49

[56] References Cited

U.S. PATENT DOCUMENTS

| | | | |
|---|---|---|---|
| 4,371,942 | 2/1983 | Damikolas | 51/165.71 |
| 4,493,168 | 1/1985 | Field, Jr. | 51/165.87 |
| 4,566,225 | 1/1986 | Bizot et al. | 51/289 R |
| 4,587,769 | 5/1986 | Cathers | 51/165.87 |
| 4,679,358 | 7/1987 | Sieradzki | 51/165.87 |
| 4,753,047 | 6/1988 | Yoshikawa et al. | 51/237 T |
| 4,791,759 | 12/1988 | Komata | 51/165.87 |
| 4,872,289 | 10/1989 | Yukawa et al. | 51/216 ND |
| 4,956,946 | 9/1990 | Tsujiuchi et al. | 51/165.71 |
| 4,967,515 | 11/1990 | Tsujiuchi et al. | 51/165.87 |
| 5,025,592 | 6/1991 | Yamamori et al. | 51/165.75 |
| 5,044,124 | 9/1991 | Niimura et al. | 51/165.87 |
| 5,216,844 | 6/1993 | Tamburini et al. | 51/165.72 |

FOREIGN PATENT DOCUMENTS

| | | | |
|---|---|---|---|
| 0394040 | 10/1990 | European Pat. Off. . | |
| 2274400 | 1/1976 | France | 51/165.87 |
| 225089 | 7/1985 | Germany | 51/165.72 |
| 15076 | 1/1987 | Japan | 51/165.72 |
| 282860 | 12/1987 | Japan . | |
| 199765 | 8/1989 | Japan | 51/165.87 |
| 131868 | 5/1990 | Japan | 51/165.87 |

*Primary Examiner*—Jack W. Lavinder
*Attorney, Agent, or Firm*—Sughrue, Mion, Zinn, Macpeak & Seas

[57] ABSTRACT

A machine for the deburring of tubular parts made from cast iron, provides a carousel upon which a deburred part is unloaded and at least one part to be deburred is loaded. Between two deburring operations, the position of at least one active point of the grinding wheel is measured by a sensor, and, after having thus measured the position of a number of points, the trajectory of the grinding wheel corresponding to the grinding wheel profile, as defined by these points, is calculated. The grinding wheel is provided to be movable, based on its profile and trajectory.

8 Claims, 3 Drawing Sheets

DEBURRING METHOD AND MACHINE

This is a Continuation of application Ser. No. 07/976,251, filed Nov. 13, 1992, now abandoned in turn a divisional of U.S. application Ser. No. 07/932,935, filed Aug. 21, 1992, now U.S. Pat. No. 5,321,914.

BACKGROUND OF THE INVENTION

This invention relates to a method and apparatus for deburring a series of parts along a seam line of each part.

Deburring is an important operation in the manufacture of cast parts, especially with respect to cast iron, since burns may have an adverse effect on their service behavior. For example, when the male end of a tubular part is inserted into another tubular part including the interposition of a sealing lining, the presence of an overthickness or a hollow along the seam line, resulting from improper deburring, can contribute to a fault in the sealing.

The deburring of parts in series by a rotary grinding wheel results in wear of the grinding wheel. One conventional practice is to monitor the quality of the deburring and to trim the active profile of the grinding wheel as the quality of deburring decreases. This process, however, is costly and is limited by the coarseness of the grinding wheel since it is difficult to trim a very coarse grinding wheel. However, increases in the grain size of the grinding wheel make it possible, with only moderate expenditures of energy, to increase the productivity of deburring.

SUMMARY OF THE INVENTION

The object of the present invention is to supply a deburring method which eliminates the need for trimming the grinding wheel and which is capable of deburring a series of parts of varied shape.

In particular, the invention is directed to a method for deburring a series of parts, along a seam line of each part, by means of a rotary grinding wheel, wherein, between two deburring operations, the position of at least one active point of the grinding wheel is measured, and, after having thus measured the position of a predetermined number of points, the trajectory of the grinding wheel, as it corresponds to the grinding wheel profile, is calculated.

In the present invention, the deburring operations and point measuring operations are alternated, and the measurement of points situated in a summit zone of the grinding wheel and the measurement of points situated outside of the summit zone are also alternated. Furthermore, the grinding wheel is displaced perpendicularly to its axis, towards the part to be deburred, at least once between two successive trajectory calculations, in order to compensate for wear to the summit zone.

The present invention is also directed to a deburring machine for implementing the above described method. This machine, of the type including a rotary grinding wheel, means for displacing the grinding wheel, and means for positioning a part having a seal line to be deburred, also includes means for measuring the position of an active point(s) of the grinding wheel, and means for calculating the trajectory of the grinding wheel as a function of these measurements and as a function of the profile of the seam line.

The measuring device of the present invention preferably includes a fixed reference point and means for bringing a predetermined point on the grinding wheel into alignment with the fixed reference point, the fixed reference point being defined by a light source and photo-electric cell.

DETAILED DESCRIPTION OF THE INVENTION

Figure 1:
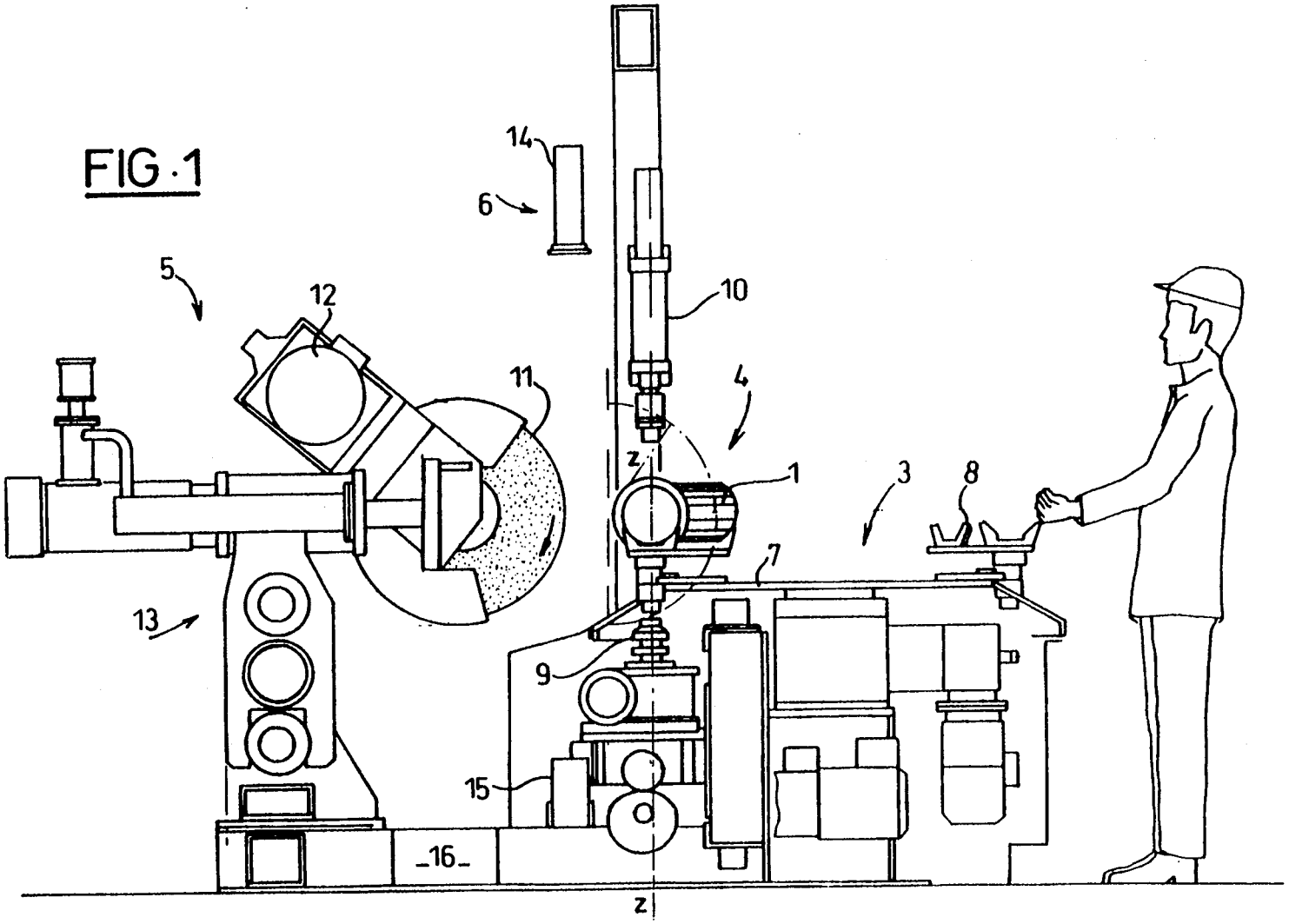
FIG. 1 is a side elevational view of a deburring machine in accordance with the present invention.
Figure 2:
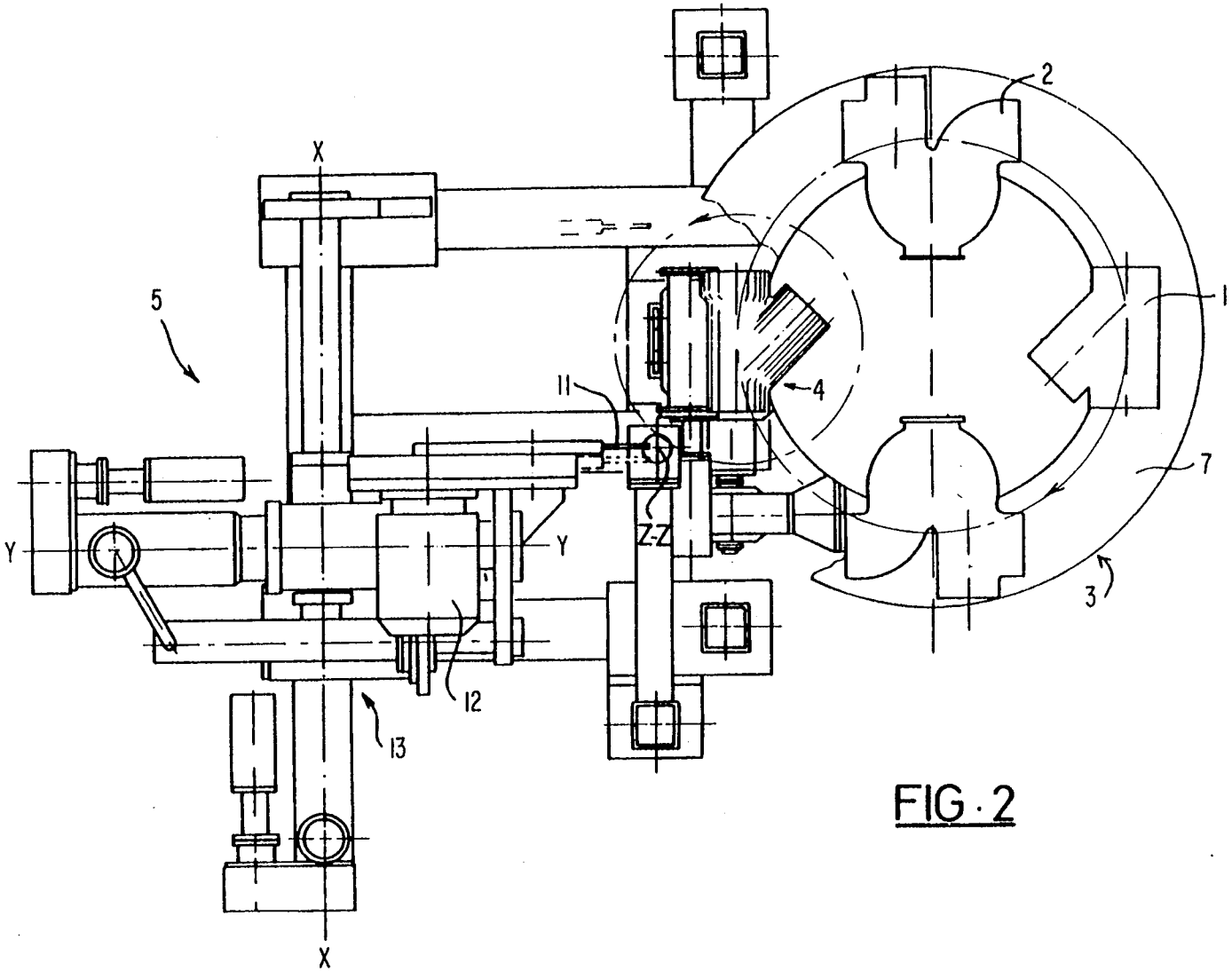
FIG. 2 is a plan view of the machine shown in FIG. 1.

The deburring machine shown in FIGS. 1 and 2 is intended to perform, in series, the deburring of tubular connections made of cast iron including Y-shaped connections 1 and U-shaped connections 2. These connections are cast in molds in two portions and thus typically contain burrs, formed along a mold seam plane, which must be eliminated.

The machine comprises a carousel 3 for successively transferring the parts 1, 2 to a deburring station 4 including a grinding device 5 and a measuring device 6.

The carousel 3 includes a rotary plate 7 on which several pivoting supports 8 are mounted. In the machine shown in FIGS. 1 and 2, there are four supports 8, each alternately supporting Y-shaped connections 1 and U-shaped connections 2.

The deburring station 4 comprises a motorized spindle 9 for engagement with the shaft of the support 8 and for supplying the support 8 with a desired angular orientation. A vertical-axis part-clamping jack 10 is provided above the station 4.

The grinding device 5 includes a grinding wheel 11 in the shape of a thin disc which, for example, may be from 400 to 650 mm in diameter and from 10 to 15 mm in thickness. Also included is a drive shaft, driven by a motor 12, and an X, Y displacement device 13. The shaft of the grinding wheel is parallel to the X-axis and perpendicular to the Y-axis, as illustrated in FIG. 2.

The measuring device 6 includes a light source 14, such as a laser, fixedly secured along the Z-axis in the vicinity of the deburring station 4 and above the grinding wheel 11. A photoelectric cell 15 is fixedly secured directly below the measuring device 6 and below the deburring station 4.

The set of movements of the carousel 3 of the spindle 9, of the jack 10, of the grinding wheel 11 and of the device 13 is controlled automatically by an electronic computer 16 with a base program for processing geometric data with respect to the parts 1, 2 as well as information obtained from the photoelectric cell.

At the beginning of a deburring operation it is assumed that the grinding wheel 11 is new and, accordingly, that its profile is known or easily determined. With a part 1 or 2 having been brought to the station 4 by the carousel 7, placed in a predetermined position by the spindle 9 and blocked by the jack 10, the computer 16 then calculates the trajectory of the grinding wheel both before and after contact with the part in order to precisely deburr a seam line.

Figure 3:
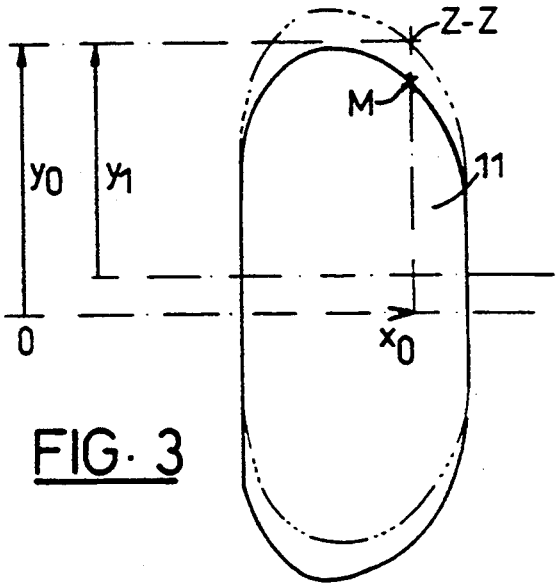
FIG. 3 is a diagrammatical illustration of the measurement of a position of an active point on the grinding wheel.

The jack 10 is then retracted after deburring, and another part is blocked in position, in the same manner, at the station 4. During the transfer of parts, the position of a predetermined point on the active surface of the grinding wheel is measured, in the following manner, as illustrated in FIG. 3.

The axis of the grinding wheel is brought a distance y0 from the optical axis (Z-axis) which distance is greater than the radius of the grinding wheel, and the grinding wheel is then displaced along the X-axis until the relevant predetermined point M coincides with the abscissa x0 of the Z-axis. The x, y coordinates are all taken with respect to a fixed reference point which may reside on the framework of the machine.

Next, the axis of the grinding wheel is displaced parallel to itself, along the Y-axis, until the luminous flux received by the cell 15 is reduced in intensity by one-half. The dimension y1 of the axis of the grinding wheel, which is also the radius of the point M with respect to the axis of the grinding wheel, is then stored in the computer 16.

Figure 4:
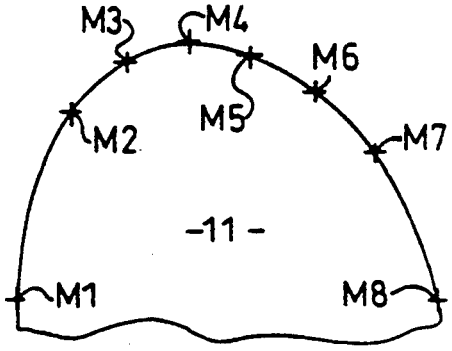
FIG. 4 is a diagrammatical illustration of a sequence for measuring the profile of the grinding wheel.

The first point M1 thus measured is situated on a side portion of the grinding wheel (FIG. 4). A second part is then deburred, as described above, and the position of a second point M2 neighboring M1 and situated at a known distance from the latter along the X-axis of the grinding wheel is measured. The deburring of a part and the measurement of a point is continued alternately in this way over B cycles. In the example of FIG. 4, n=8.

Figure 5:
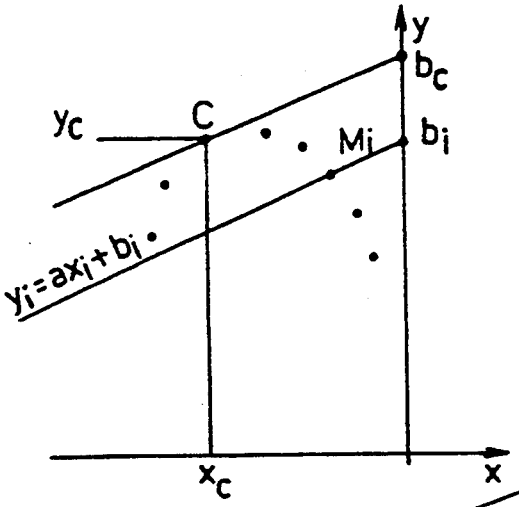
FIG. 5 illustrates a process for determining the active point on the grinding wheel.
Figure 6:
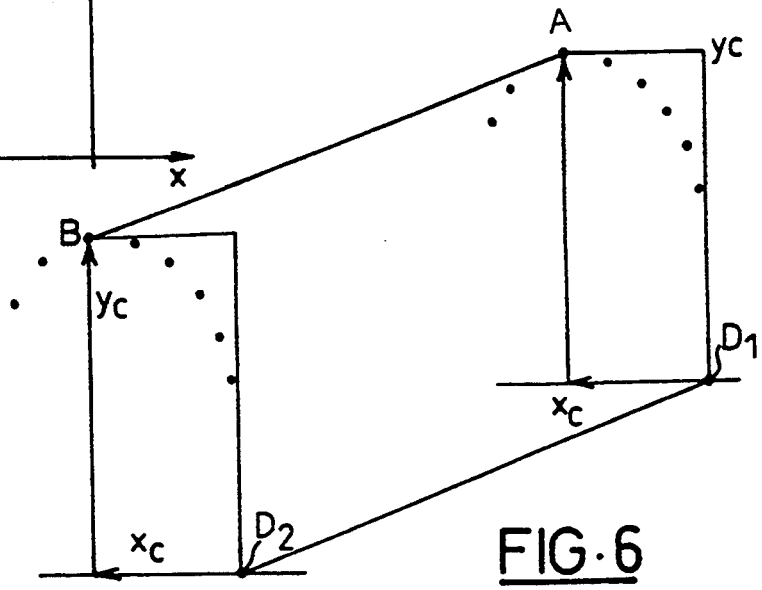
FIG. 6 illustrates a process for calculating the trajectory of the grinding wheel.

When n cycles are completed, the computer has stored the coordinates of the n points thus measured, and the active point or point on the grinding wheel that contacts the part for the deburring operation may be determined as follows ( See FIGS. 5 and 6 ).

The computer 16 stores an equation of the seam line to be deburred. For simplicity, it is assumed that it is a straight segment AB, having a slope a= (yB−yA)/(xB−xA). A straight line also having a slope a which passes through any point Mi of the grinding wheel has the equation y=ax+bi, with yi=axi+bi. Thus, for the n points measured, the value of bi is calculated, and the active point, or point of contact, which is sought is that for which bi is a maximum. This point is designated by C in FIG. 5.

The trajectory of a predetermined point of the grinding wheel, for example of the center D of its extreme right face (in FIG. 6), is calculated as follows.

In order to deburr from the initial point A to set sequence point B via the grinding wheel point C, the point D is at D1 such that xA=xD1+xC and yA=yD1+yC where the coordinates of point A are xA and yA.

Likewise, in order to deburr from the final point B via the point C, the point D is at D2 such that the line xB=xD2+xC and yB=yD2+yC.

The deburring of the segment AB is obtained by displacement of the point D from D1 to D2.

Thus, a large number of deburring operations can be performed, on parts of various shapes, without the need for trimming the grinding wheel. This makes it possible to increase deburring productivity while maintaining a coarse grinding wheel. A coarse grinding wheel is more efficient and consumes a relatively small amount of energy.

Furthermore, a fixed light beam (FIG. 1) eliminates the need for supplementary moving parts and makes it possible to perform the necessary measurements in a more rapid and reliable fashion.

Figure 7:
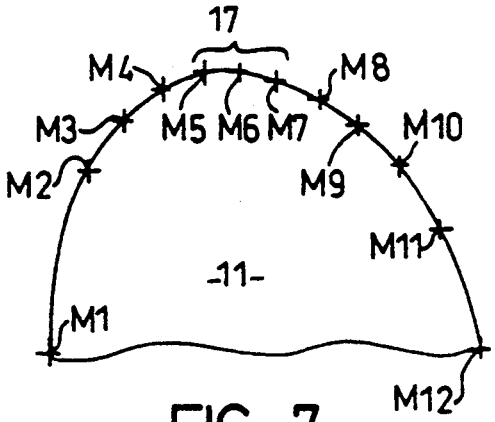
FIG. 7 is a view similar to FIG. 4 of a variant of the measuring sequence.

In the method illustrated in FIG. 7, twelve measuring points M1 to M12 are regularly distributed along the X-axis, the three middle points M5 to M7 being situated in a summit zone 17 of the grinding wheel. The deburring and measurement operations are alternated as described below.

The points M1, M5, M2, M6, M3 and M7 are measured and the grinding wheel is then moved along the Y-axis to compensate for wear to the summit zone 17, the amount of wear being calculated from the measurements of M5, M6 and M7.

The points M4, M5, M8, M6, M9 and M7 are measured next and the grinding wheel is again moved along the Y-axis to compensate for additional wear.

Finally, the points M10, M5, M11, M6, M12 and M7 are measured and a new trajectory is calculated as described above with respect to FIGS. 5 and 6.

The above described method of the present invention allows for intermediate corrections between successive calculations of the trajectory. This method is particularly useful given that the grinding wheel undergoes rapid, uniform global wear along the Y-axis.

In another method, the deburring and measurement operations are performed in an overlapping time sequence so that the unloading of a deburred part and the loading of a subsequent part to be deburred occur simultaneously with the measurement of the position of a point on the grinding wheel.

In still another method, a three-dimensional measurement for performing a three-dimensions deburring operation on flash (e.g., a seam line having three dimensions) formed on a part which is symmetric with respect to a seam plane i.e., having plane symmetry.

I claim:

1. A deburring machine comprising a rotary grinding wheel (11), means (13) for displacing the grinding wheel perpendicularly to an axis of rotation of said grinding wheel, towards a part to be deburred, means (8, 9, and 10) for positioning said part (1, 2), and further comprising means (6) for measuring a position of at least one active point of the grinding wheel and means (16) for calculating a trajectory of the grinding wheel as a function of the position of said at least one active point of the grinding wheel and as a function of a profile of a seam line of the part to be deburred, wherein said measuring means (6) comprises means for establishing a fixed reference and means (13) for bringing a predetermined point of the grinding wheel into coincidence with said fixed reference, said means for establishing a fixed reference including a light source (14) and a photoelectric cell (15) disposed along a line orthogonal to both the axis of rotation of said grinding wheel and to a direction in which said grinding wheel is displaced toward a part to be deburred.

2. A machine for deburring a series of parts along a seam line of each part by means of a rotary grinding wheel, comprising:

a) means for performing a first deburring operation;

b) means for measuring a position of at least one active point of the rotary grinding wheel;

c) means for calculating a trajectory of the rotary grinding wheel, said trajectory corresponding to a rotary grinding wheel profile, as determined by the position of said at least one active point;

d) means for performing a second deburring operation based on a calculated trajectory of said rotary grinding wheel;

e) means for alternating a measurement of points situated in a summit zone of the rotary grinding wheel with the measurement of points situated outside of said summit zone; and f) means for displacing the rotary grinding wheel perpendicularly to an axis of rotation of said grinding wheel, towards the part to be deburred, at least once between two successive trajectory calculations so as to compensate for wear within said summit zone.

3. A machine according to claim 2, further comprising means for consecutively repeating said first deburring operation, said point position measuring, said trajectory calculating and said second deburring operation a predetermined number of times.

4. A machine according to claim 3, wherein the first and second deburring operation performing means, the point position measuring means, and the trajectory calculating means all function in an overlapping time sequence.

5. A deburring machine comprising:

a rotary grinding wheel (11);

means (13) for displacing the grinding wheel perpendicularly to an axis of rotation of said grinding wheel, towards a part to be deburred;

means (8, 9 and 10) for positioning said part (1, 2);

means (6) for measuring a position of at least one active point of the grinding wheel and means (16) for calculating the trajectory of the grinding wheel as a function of the position of said at least one active point of the grinding wheel and as a function of a profile of a seam line of the part to be deburred;

means (7) for unloading a deburred part from a deburring station and for loading a part to be deburred to said deburring station, while said measuring means (6) measures said position of said at least one active point.

6. A deburring machine according to claim 5, wherein said measuring means (6) comprises means for establishing a fixed reference and means (13) for bringing a predetermined point of the grinding wheel into coincidence with said fixed reference.

7. A deburring machine according to claim 6, wherein said means for establishing a fixed reference includes a light source (14) and a photoelectric cell (15).

8. A deburring machine according to claim 6, wherein said means for establishing a fixed reference includes a light source (14) and a photoelectric cell (15) disposed along a line orthogonal to both the axis of rotation of said grinding wheel and to a direction in which said grinding wheel is displaced toward a part to be deburred.

* * * * *